US005951127A

United States Patent [19]

Smith

[11] Patent Number: 5,951,127

[45] Date of Patent: Sep. 14, 1999

[54] MODULAR INTERLOCKING CABINETS

[76] Inventor: John Houston Smith, 237 New Zion Rd., Winnsboro, La. 71295

[21] Appl. No.: 09/099,577

[22] Filed: Jun. 18, 1998

[51] Int. Cl.[6] ..... A47B 45/00; A47B 67/02

[52] U.S. Cl. ..... 312/205; 312/245; 312/198; 248/909

[58] Field of Search ..... 312/205, 204, 312/195, 198, 107, 257.1, 263, 245, 246, 199, 140.1, 297; 52/36.1, 36.5, 98; 211/94.01; 248/909; 108/51.3, 157.14

[56] References Cited

U.S. PATENT DOCUMENTS

| | | | |
|---|---|---|---|
| 3,352,615 | 11/1967 | Sandin | 312/204 X |
| 3,472,571 | 10/1969 | Himelreich | 312/259 |
| 3,926,486 | 12/1975 | Sasnett | 312/198 |
| 3,950,049 | 4/1976 | Drass | 312/198 X |
| 4,329,003 | 5/1982 | Manchester | 312/245 |
| 4,567,930 | 2/1986 | Fischer | 248/909 X |
| 5,040,316 | 8/1991 | Fast | 248/909 X |
| 5,718,493 | 2/1998 | Nikolai | 312/245 |
| 5,823,645 | 10/1998 | Darling | 312/297 |

FOREIGN PATENT DOCUMENTS

| | | | |
|---|---|---|---|
| 865599 | 3/1971 | Canada | 312/198 |
| 2202109 | 8/1973 | Germany | 312/198 |
| 94/08487 | 4/1994 | WIPO | 312/198 |

*Primary Examiner*—Peter M. Cuomo
*Assistant Examiner*—James O. Hansen
*Attorney, Agent, or Firm*—Joseph L. Lemoine, Jr.; Jessie D. Lambert; Greg R. Mier

[57] ABSTRACT

An improved prefabricated cabinet assembly similar in appearance to professionally installed customized cabinets, but that is easily, quickly and inexpensively installed in different configurations. The cabinet assembly comprises at least one cabinet unit having opposed sides and a rear wall. A hanger assembly is provided to suspend the cabinet units on a wall structure, comprising a horizontal bar mounted to the rear wall of the cabinet units having a downward-facing groove, interlocked with a horizontal bar mounted on the wall structure which has a corresponding upward-facing groove. The hanger assembly permits sliding cabinet units along the wall to a desired spaced-apart position. Spacer panels are mounted to span the spaces between adjacent cabinet units. Each of the spacer panels has a plurality of spaced apart grooves cut into its rear face, along with a plurality of visible, spaced apart cut lines to permit easy cutting of the spacer panels at desired widths. Dual, opposing hanger bars may be provided on the rear walls of the cabinet units to permit inverting each unit as desired for optimum door swing.

7 Claims, 8 Drawing Sheets

MODULAR INTERLOCKING CABINETS

BACKGROUND

1. Field of the Invention

The subject invention generally relates to improvements in cabinet construction and more specifically relates to prefabricated modular cabinets that are designed for layman installation and can be easily adapted to fit along various lengths and configurations of wall spaces.

2. Description of the Related Art

A great majority of cabinets in homes, apartments, offices and the like, are custom built on site and installed by highly skilled carpenters during the course of construction of the home, apartment, office, etc. Typically, the general contractor schedules the carpenters to begin building and installing the cabinets after the walls have been erected and covered with some type of wallboard. While at the construction site, the carpenters custom cut the various cabinet structures to fit the designated wall space. After the cabinets are in place, other subcontractors, such as painters, electricians and plumbers are scheduled to perform their part of the construction project. This method of constructing and installing cabinets is time consuming and requires a relatively high degree of carpentry skills, which usually results in higher costs for the consumer.

With the increased costs of skilled carpentry labor, and the extensive time required to install custom built cabinetry, consumers have sought alternative methods for obtaining professional looking cabinetry with less investment in time and money. One such method is to manufacture and ship prefabricated cabinet assemblies directly to the construction site for installation. U.S. Pat. No. 3,926,486 to Sasnett discloses such a cabinet system where the installation of prefabricated floor-to-ceiling modular kitchen units is facilitated by a corner unit that permits the insertion of spaced connectors for joining modular units in an L-shaped layout.

Another version of a prefabricated cabinet system is presented in U.S. Pat. No. 3,993,377 to Montroy, wherein the prefabricated cabinet assembly implements an intermediate bulkhead construction to eliminate double panel construction, thereby substantially reducing the material and transportation costs involved.

U.S. Pat. No. 3,892,452 to Williams et al discloses a modular cabinet system composed of cabinets which have sloping sidewalls and a sloping top wall to enable nesting of the cabinets during storage and shipment.

Unlike the modular cabinet assembly of the present invention, the cabinet assemblies disclosed in the aforementioned prior art have a common problem in that they fail to provide cabinet assemblies that can be adjusted to any length and configuration of wall space and can be installed by persons with relatively little carpentry skills. The present invention satisfies such a need by providing prefabricated, modular cabinet assemblies that have a professionally installed appearance and that can be fitted along any length of available wall space by those who have minimal carpentry skills

SUMMARY OF THE INVENTION

The primary purpose of the present invention is to provide a cabinet system that is similar in appearance to professionally installed customized cabinets, but is easily, quickly and inexpensively installed in various room configurations by persons who have relatively little carpentry skills.

Generally, the cabinet assembly of the present invention includes one or more modular cabinet units, hangers for mounting the modular cabinet units (or group of cabinet units), and spacer boards for adjusting the distance between the modular cabinet units, if necessary. The modular cabinet units are generally box-shaped and are designed to contain either shelves or drawers, or a combination thereof. Each modular cabinet unit has a door with hinges that can be installed on either side of the cabinet opening so that the door can swing open either right or left.

Cabinet hangers can be used to mount the modular cabinet units at floor level or at any other desired height. The cabinet hangers are basically a set of substantially horizontal beams attached to the wall where the modular cabinet unit(s) will be installed and attached across the rear of each modular cabinet unit. The cabinet hangers attached to the wall interlock with the cabinet hangers attached to the rear wall of each modular cabinet unit(s) to allow lateral adjustment of the modular cabinet unit(s) along the wall. The cabinet hangers attached to the rear of each modular cabinet unit(s) are spaced apart with opposing interlocking edges so that the consumer can rotate the modular cabinet unit(s) 180 degrees about an axis running horizontally from front to back of the modular cabinet unit(s), or in effect invert the cabinet unit(s). This unique feature increases the flexibility a consumer has when configuring the modular cabinet unit(s) along any particular wall space.

When multiple modular cabinet units are mounted adjacent to each other along a wall structure, spacer panels can be positioned therebetween to provide the proper spacing so that the group of modular cabinet units, together with the spacer panels, uniformly fills the wall space as desired. The spacer panels are easily adjustable to vary the distance between the modular cabinet units so as to allow the consumer to evenly (or if desired, unevenly) space multiple modular cabinet units along any length of wall space without having to extensively modify the width of each modular cabinet unit.

Other aspects, advantages and objects of the invention will become apparent to those skilled in the art upon reviewing the following detailed description, the drawings and appended claims.

DESCRIPTION OF THE PREFERRED EMBODIMENT

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
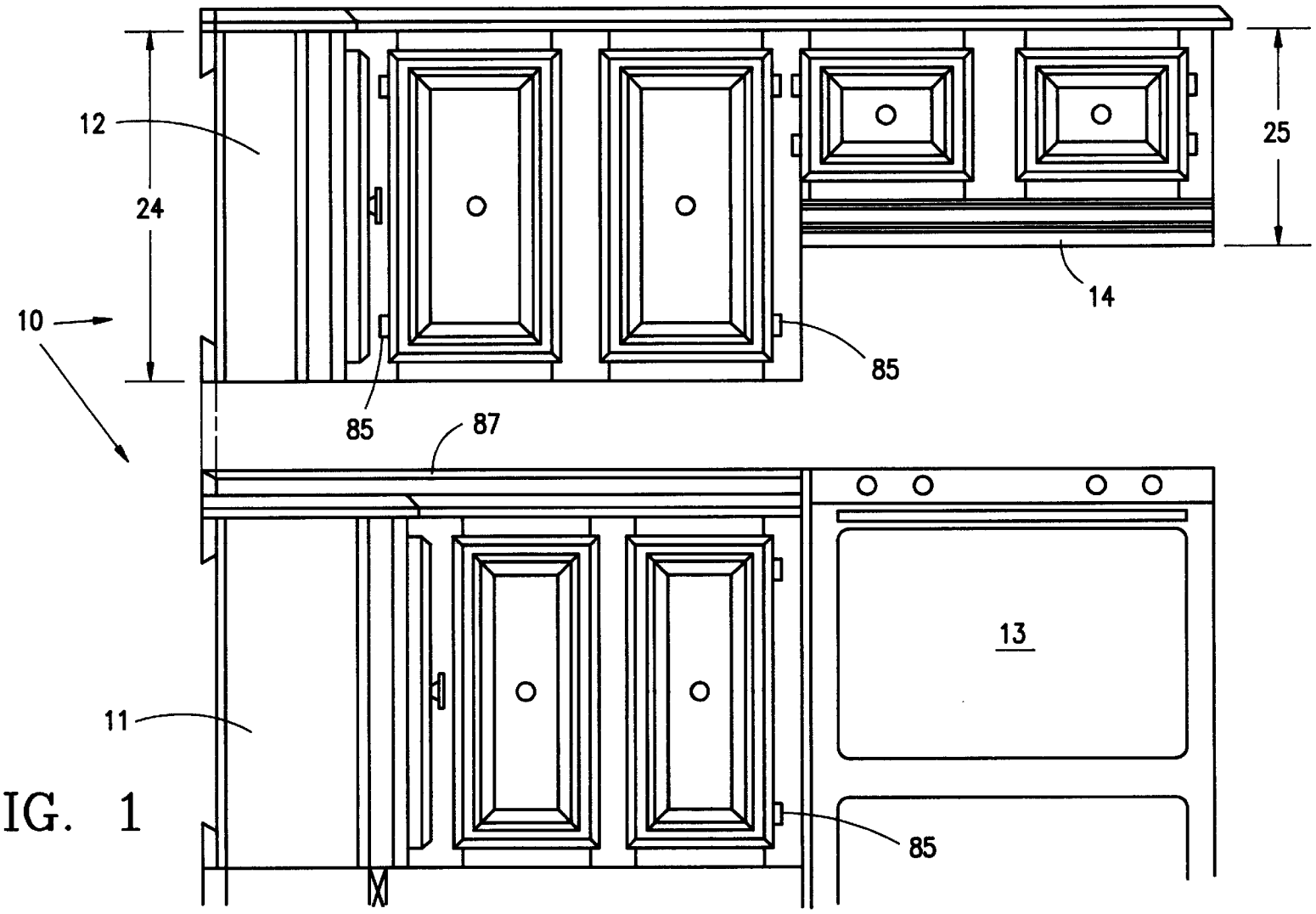
FIG. 1 is a front elevation view of a prefabricated cabinet assembly, including wall cabinets and floor cabinets, constructed in accordance with the present invention.
Figure 2:
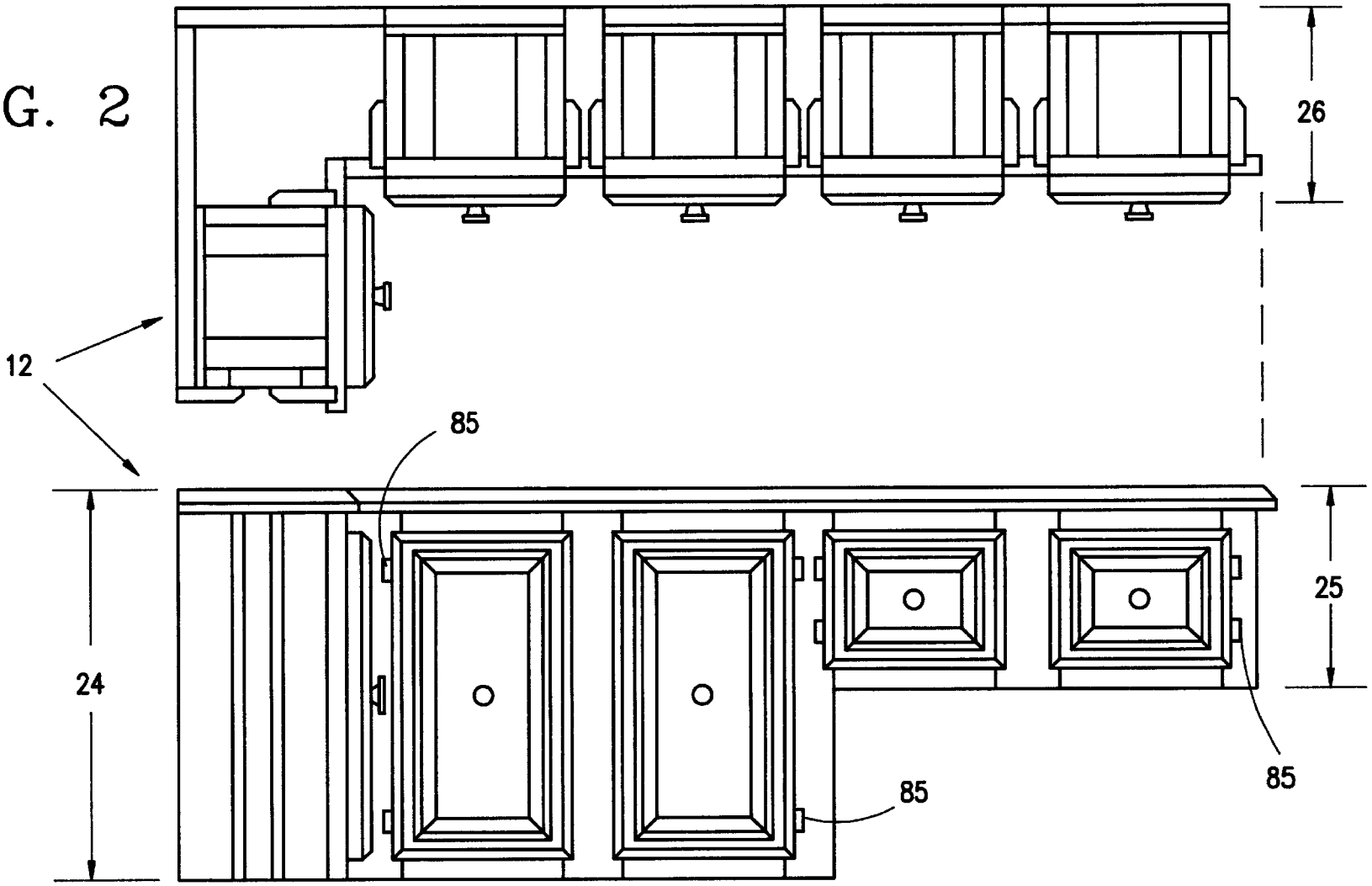
FIG. 2 is a top plan view and front elevation view of the prefabricated wall cabinet assembly of FIG. 1.

Referring now to FIG. 1, a typical configuration of the prefabricated modular cabinet assembly 10 as made in accordance with the present invention is illustrated, where floor cabinets 11 and wall cabinets 12 are arranged in an L-shaped pattern, and where one end of cabinet assembly 10 abuts a range 13 and accompanying hood 14. FIG. 2 is a top view and plan view of wall cabinets 12.

Figure 3:
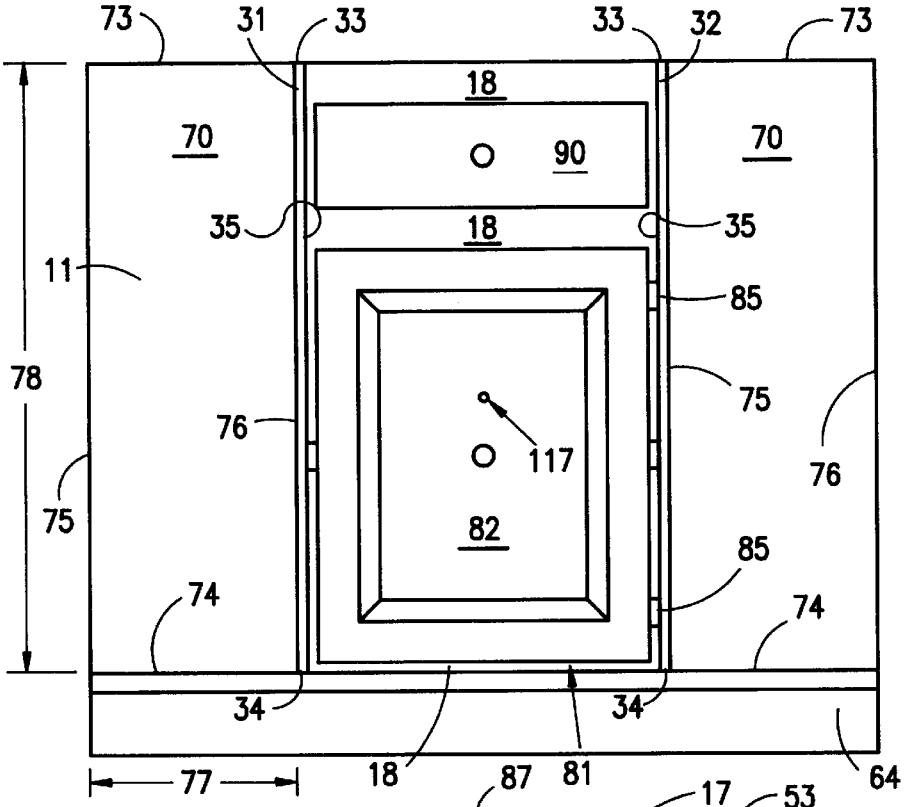
FIG. 3 is a front elevational of the cabinet unit constructed in accordance with the present invention.
Figure 4:
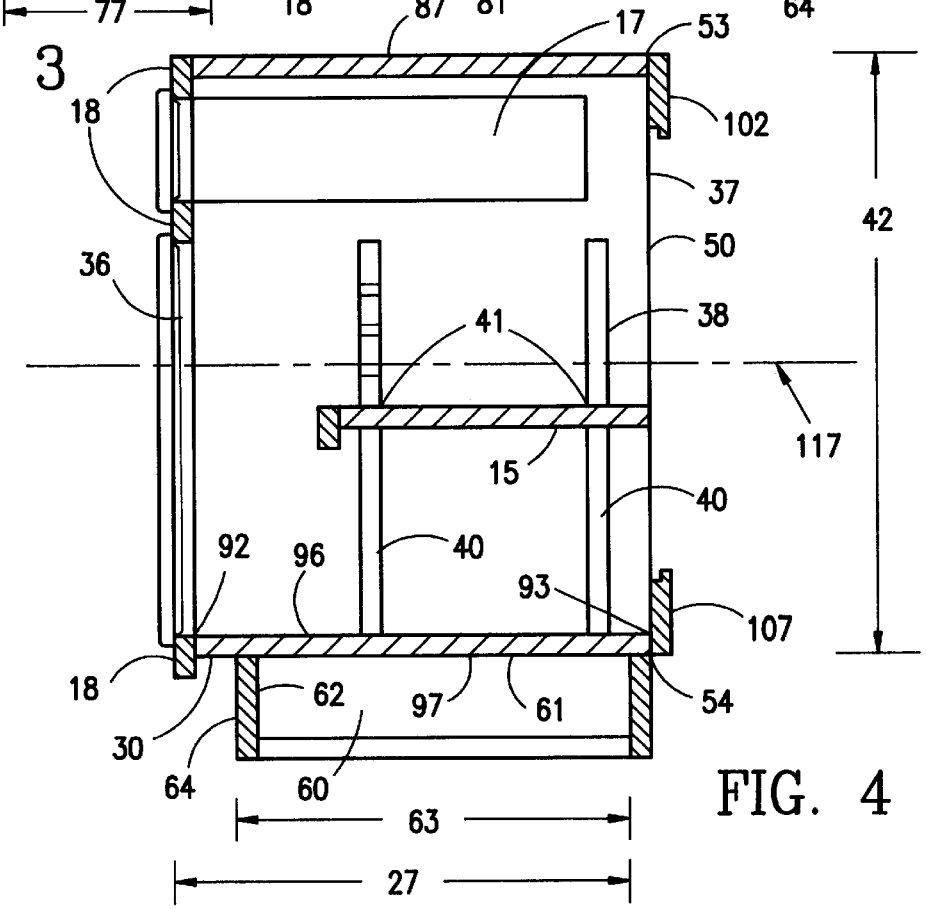
FIG. 4 is a side elevational view, in section, of the cabinet unit constructed in accordance with the present invention.
Figure 5:
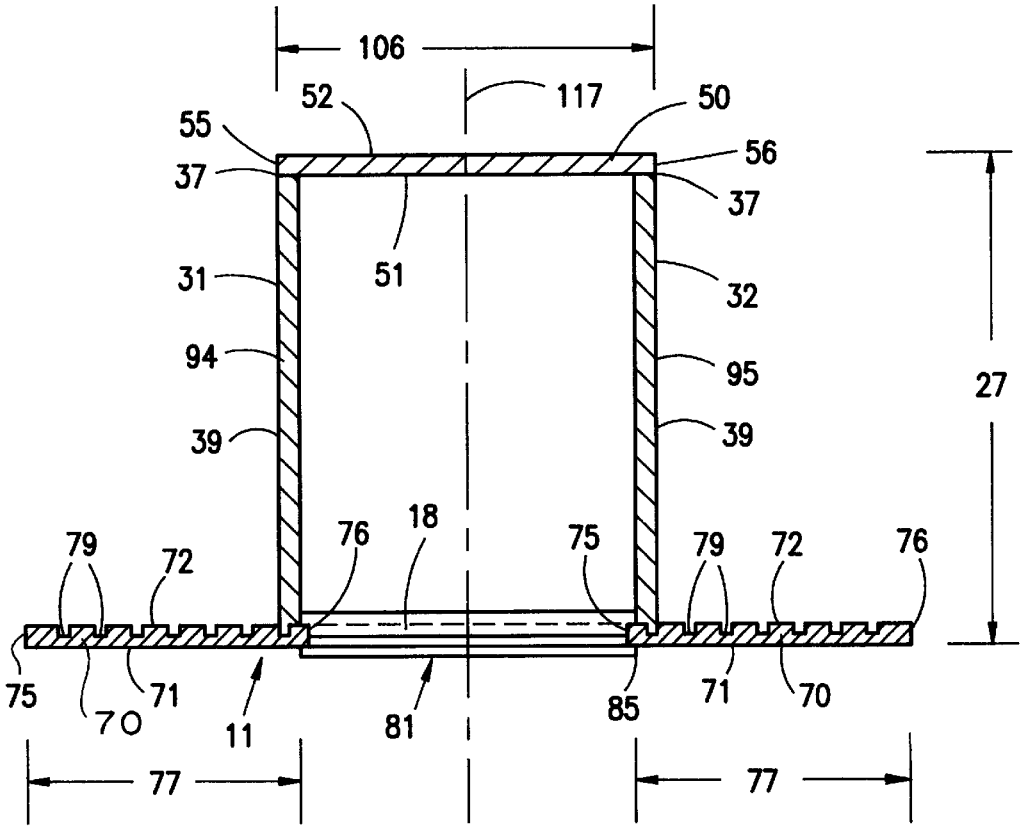
FIG. 5 is a top plan view of the cabinet unit constructed in accordance with the present invention.

An exemplary floor cabinet 11 is shown in FIGS. 3 through 5. Floor cabinet 11 preferably includes a bottom 30, a left-hand side wall 31, a right-hand side wall 32, a rear wall 50, front facing beams 18, and a plurality of support members 60.

As shown in FIGS. 3 through 5, both side walls 31 and 32 of floor cabinet 11 are preferably constructed of flat panels which lie in vertical, parallel planes. Side walls 31 and 32 can be of substantially identical construction, where left-hand side wall 31 is merely a mirror image of right-hand side wall 32. As shown in FIGS. 3 and 4, both side walls 31 and 32 have a top 33, a bottom 34, an inner face 35, a front vertical edge 36, and a rear vertical edge 37. Inner face 35 of each side wall 31 and 32 is fitted with support means 38 for mounting shelves 15 and/or drawer guides 16 for guiding and supporting drawers 17.

Figure 8:
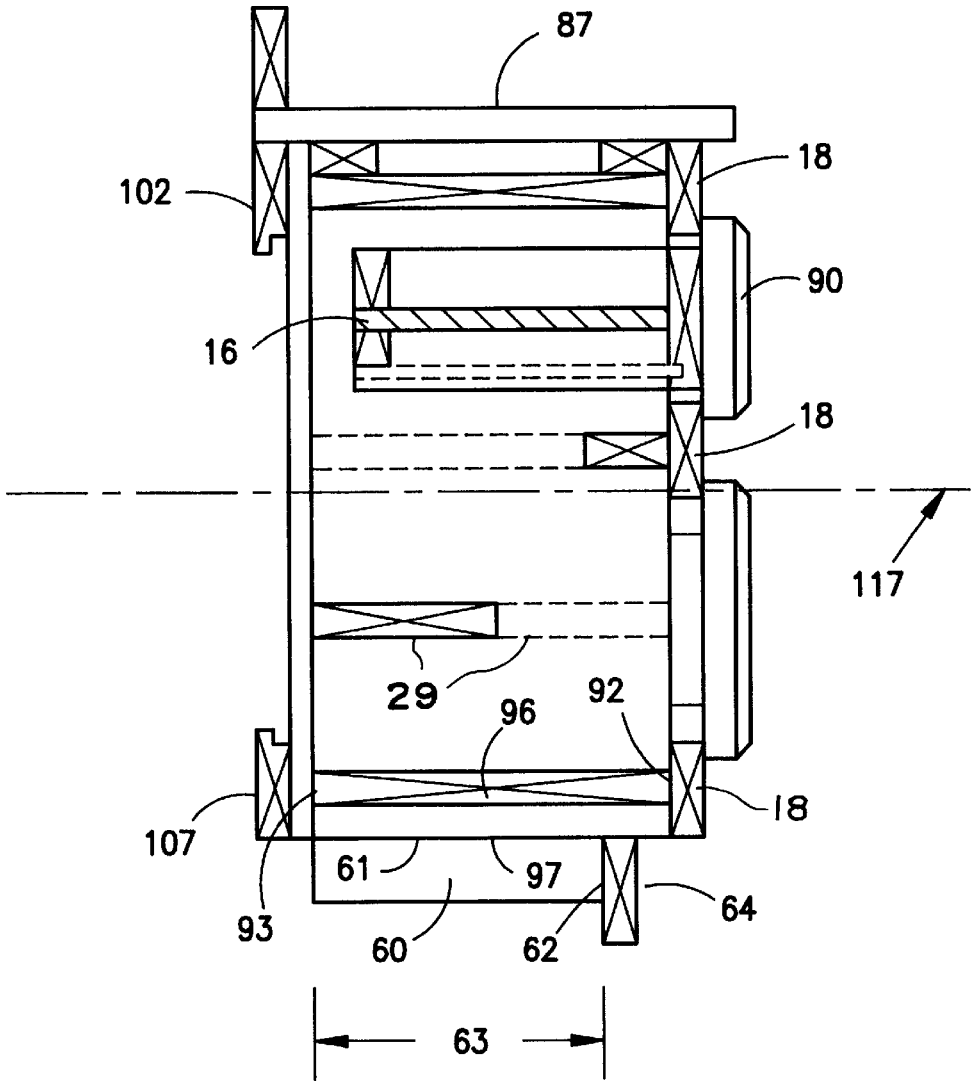
FIG. 8 is a side elevational view of a cabinet unit which is equipped for containing both drawers and shelves.
Figure 10:
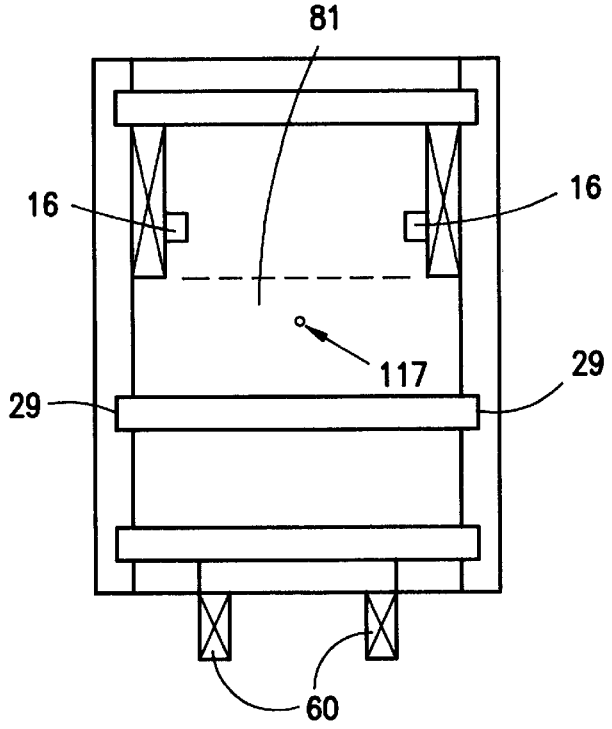
FIG. 10 is a front elevational view of the frame of the cabinet unit constructed in accordance with the present invention.

Support means 38 can be, but are not limited to, horizontal grooves 29 carved into inner face 35 of side walls 31 and 32, as shown in FIGS. 8 and 10, or vertical brackets 40 with adjustable support tabs 41, as shown in FIG. 4. Drawer guides 16 can be horizontally disposed on inner face 35 of side walls 31 and 32 in equally spaced apart vertical relation, as shown in FIGS. 8 and 10.

Rear wall 50 of floor cabinet 11 preferably has a front face 51, a back face 52, an upper edge 53, a lower edge 54, a left-side edge 55 and right-side edge 56. In the preferred embodiment, rear vertical edge 37 of left-hand side wall 31 is connected perpendicularly to front face 51 of rear wall 50 so that outer face 39 of left-hand side wall 31 is flush with the left side edge 55 of rear wall 50, and support means 38 and/or drawer guides 16 are facing inwardly toward right side edge 56 of rear wall 50. Likewise, rear vertical edge 37 of right-hand side wall 32 is connected perpendicularly to front face 51 of rear wall 50 so that outer face 39 of right-hand side wall 32 is flush with right side edge 56 of rear wall 50 and support means 38 and/or drawer guides 16 are facing inwardly toward left-hand side wall 31 and are substantially in the same horizontal plane as the corresponding support means 38 and/or drawer guides 16 on left-hand side wall 31.

Now referring to FIGS. 4 and 5, bottom 30 of floor cabinet 11 preferably has a front edge 92, a rear edge 93, a left side edge 94, a right side edge 95, an upper face 96, and a lower face 97. Rear edge 93 is connected perpendicularly to front face 51 of rear wall 50 in close proximity to lower edge 54 so that upper face 96 of bottom 30 of floor cabinet 11 is facing upwards. Similarly, left side edge 94 and right side edge 95 of bottom 30 of floor cabinet 11 are connected perpendicularly to inner face 35 near bottom 34 of left hand side wall 31 and right hand side wall 32, respectively.

Having rear wall 50, side walls 31 and 32, and bottom 30 in place, front facing beams 18 complete the basic framework of floor cabinet 11. As shown in FIGS. 3, 4, 6, 8, and 12, front facing beams 18 are preferably disposed at various locations along height 42 of floor cabinet 11 in a vertical plane normal to side walls 31 and 32. Front facing beams 18 preferably extend between midpoints 43 on vertical front edges 36 of left-hand side wall 31 and right-hand side wall 32. The exposed surfaces 19 of front facing beams 18 are preferably finished to enhance the professionally installed appearance of modular cabinet assembly 10.

Now referring to FIGS. 4, 8, and 10, floor cabinet 11 preferably includes a plurality of support members 60, each having a top 61, a front edge 62, and a length 63. The primary purpose of support members 60 are to support the weight of floor cabinet 11 and provide a kick space between the surface of floor 28 and bottom 30 of floor cabinet 11.

A first support member 60 is longitudinally and horizontally disposed along lower face 96 of bottom 30 of floor cabinet 11 in close proximity to and parallel with left side edge 93 of bottom 30, while a second support member 60 is longitudinally and horizontally disposed along lower face 96 of bottom 30 of floor cabinet 11 in close proximity to and parallel with right side edge 94 of bottom 30 of floor cabinet 11.

Length 63 of each support member 60 is preferably shorter than depth 27 of floor cabinet 11 so as to accommodate a kick space facing member 64, which is connected perpendicularly to front edge 62 of both support members 60, as shown in FIGS. 3, 4, and 8. Kick space facing member 64 preferably provides a finished surface between floor 28 and bottom 30 of floor cabinet 11, thereby adding to the professionally installed appearance of modular cabinet assembly 10.

Figure 7:
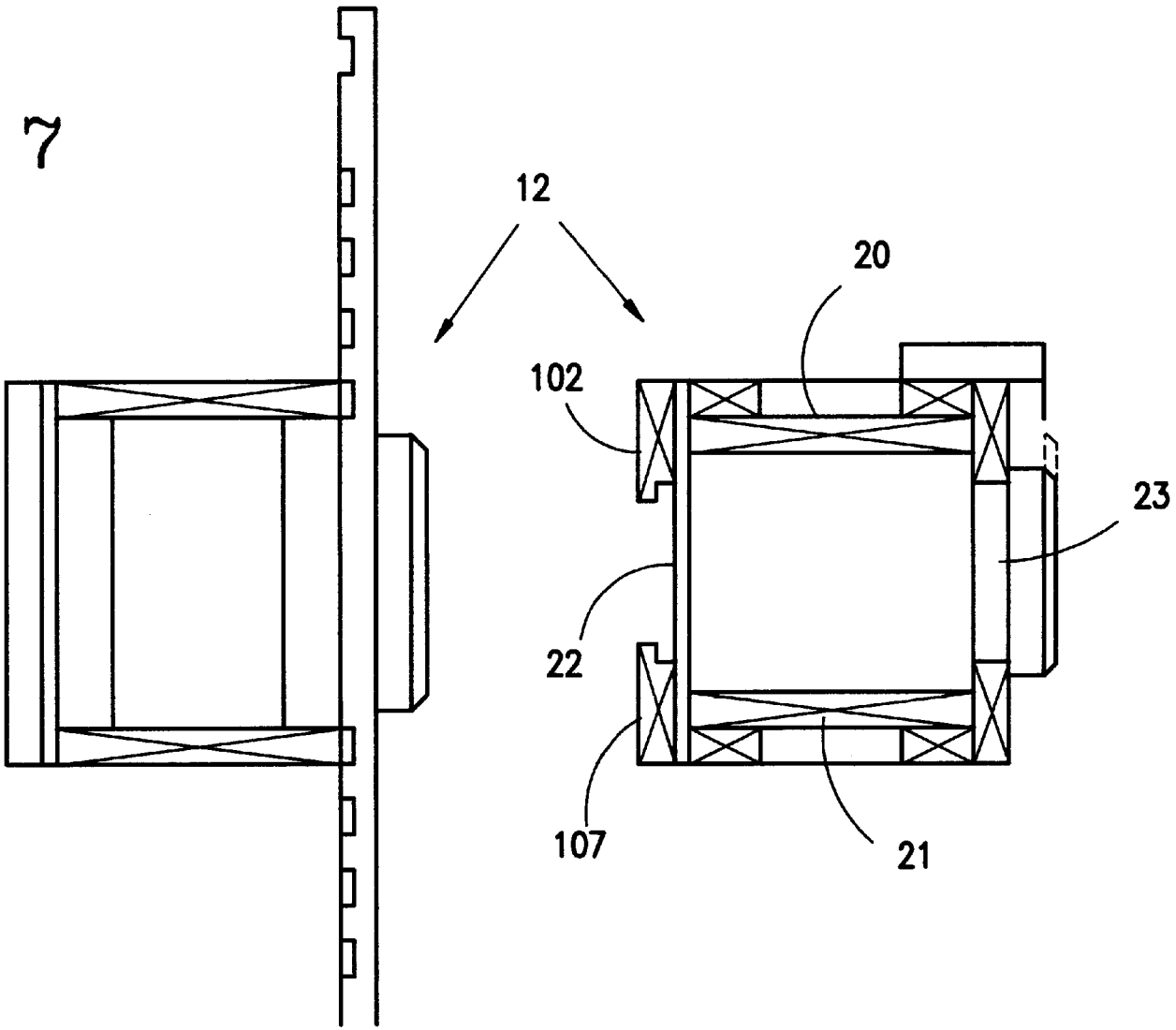
FIG. 7 is a top plan view and side elevational view of a short cabinet unit as constructed in accordance with the present invention.

Wall cabinet 12 may be constructed similarly to floor cabinet 11, as shown in FIGS. 2 and 7. Referring to FIG. 7, wall cabinets 12 have a top 20, a bottom 21, a back 22, and a front 23. Referring to FIG. 2, wall cabinets 12 can be manufactured having either a standard height 24 or a shortened height 25 to accommodate various kitchen appliances, such as a range 13 and hood 14 or refrigerator (not shown). Depth 26, shown in FIG. 2, of wall cabinets 12 is preferably, but not always, less than depth 27 of floor cabinets 11.

Figure 6:
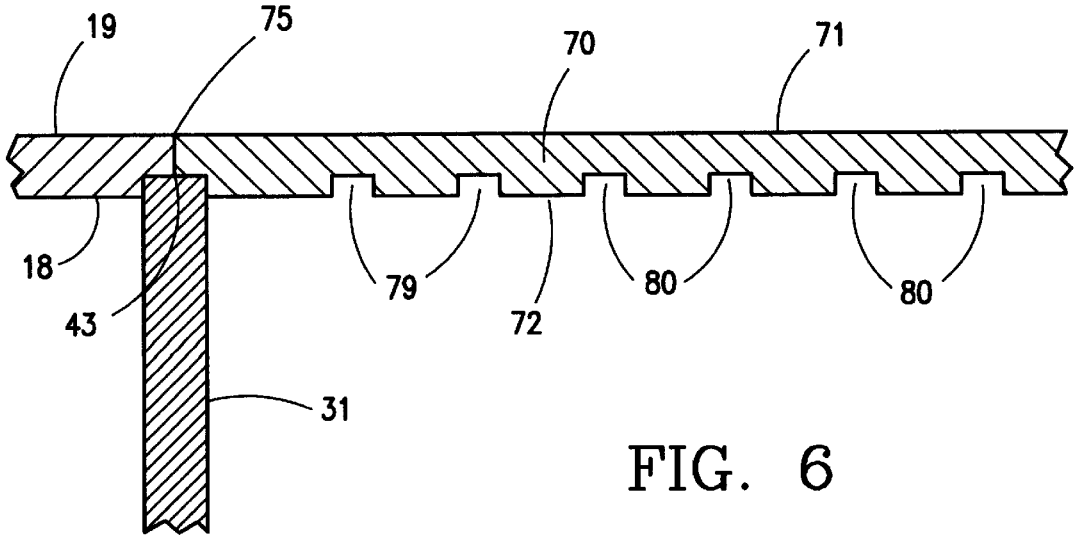
FIG. 6 is a top plan view of the spacer panel as constructed in accordance with the present invention.

Referring now to FIGS. 3, 5, and 6, adjacent cabinet units comprising both floor cabinets 11 and wall cabinets 12 can be connected using spacer panels 70, which enable the consumer to adjust the distance between adjacent floor cabinets 11 and wall cabinets 12 to enhance the professionally installed appearance of cabinet assembly 10 by uniformly filling the available wall space. Spacer panel 70 has a front face 71, a back face 72, a top edge 73, a bottom edge 74, two side edges 75 and 76, a width 77, and a height 78 which can be adjusted to the height of either floor cabinets 11 or wall cabinets 12, depending on which type cabinet is to be interconnected. If it is necessary to connect two cabinets having different heights, then height 78 of spacer panel 70 is preferably equal to that of the taller of the two connected cabinets. Front face 71 of spacer panel 70 is preferably finished, while back face 72 is unfinished and has multiple vertical slots 79, which are spaced apart and extend along the entire height 78 of spacer panel 70. In the preferred embodiment, the spacing between each of slots 79 is equal.

In the preferred embodiment, spacer panel 70 is attached to a floor cabinet 11 or wall cabinet 12 by fitting front vertical edge 36 of side wall 31 or 32 into the outer most vertical slot 79, which has been cut along a cut line 80, as shown in FIG. 6. In this configuration, top edge 73 of spacer panel 70 is flush with top 33 of side walls 31 and 32, bottom edge 74 of spacer panel 70 is flush with bottom 34 of side walls 31 and 32, and front face 71 of spacer panel 70 is substantially coplanar with exposed surface(s) 19 of front facing beam(s) 18.

Referring again to FIG. 6, in the preferred embodiment, cut lines 80 are located parallel to and centrally along vertical slots 79. Cut lines 80 enable a person with minimal carpentry skills to adjust width 77 of spacer panels 70 in order to better utilize the space available along any length of wall space upon which modular cabinet assembly 10 may be installed. Once the length of available wall space is determined, spacer panels 70 can be cut along any cut line 80 to optimize the number of floor cabinets 11 and/or wall cabinets 12 to be installed along the available wall space. This feature of the present invention minimizes the level of skill necessary to install modular cabinet assembly 10 along any length of wall space.

Cut line 80 may be marked along the base of slots 79 to provide a visual aid for cutting with a saw or other like means. It is understood, however, that alternative embodiments of the present invention may employ cut lines 80 at substantially the center of the sections intermediate slots 79.

Once cabinet assembly 10 is in place, a cabinet top 87 can mounted on said cabinet assembly 10 as shown in FIGS. 1, 4, and 8.

Figure 9:
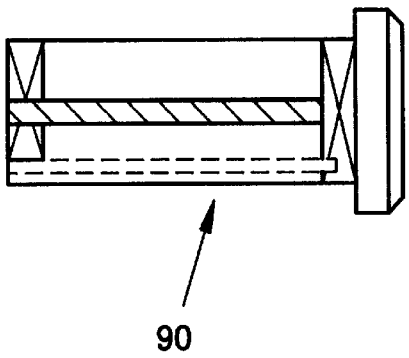
FIG. 9 is a side elevational view of a drawer assembly constructed in accordance with the present invention.

Now referring to FIG. 3, cabinet opening 81 is preferably covered with a door assembly 82 and/or a drawer assembly 90, as shown in FIGS. 8 and 9. Door assembly 82 preferably has door pulls 83 which are positioned at the center of outer face 86. Door assembly 82 also can have a raised panel 84 and may be attached to cabinet assembly 10 with hinges 85 that are secured to front face 71 of adjacent spacer panel 70, as shown in FIGS. 1, 2, 3, and 5. An important feature of door assembly 82 is that it can be mounted to cabinet assembly 10 with hinges 85 on either the right or left side of cabinet opening 81. This feature provides flexibility to the consumer when installing modular cabinet assembly 10 by allowing the consumer to choose whether door assembly 82 will swing open to the left or swing open to the right. This feature is especially important when installing cabinet assembly 10 in an L-shaped pattern, as shown in FIGS. 1 and 2. Hinges 85 can be positioned on either side of cabinet opening 81 to ensure that door assembly 82 opens freely and that the consumer has unrestrained access into cabinet opening 81.

Means for mounting the cabinet assembly 10 of the present invention to a wall structure are provided, for both floor cabinets 11 and/or wall cabinets 12, as will be hereinafter described.

Figure 11:
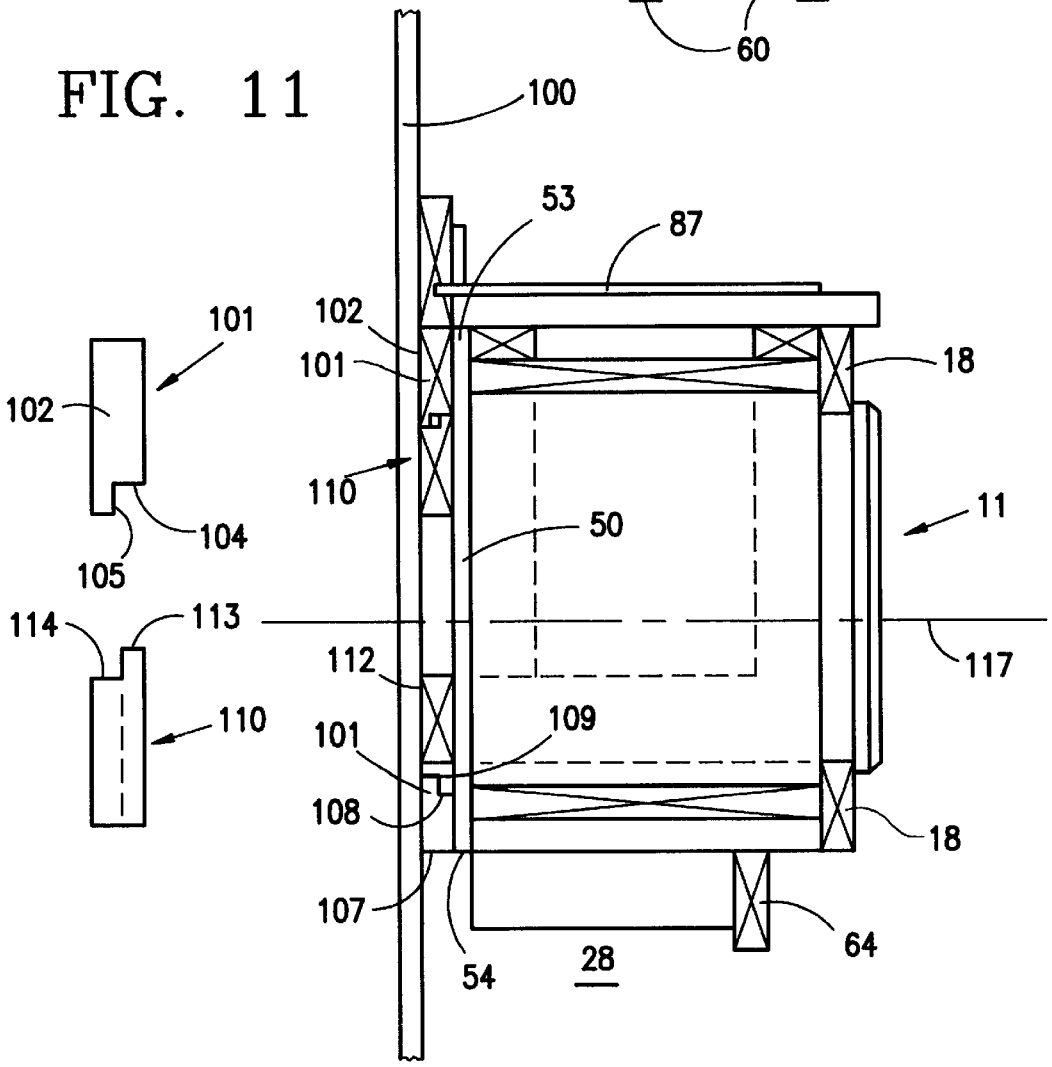
FIG. 11 is a side elevational view of the cabinet and wall hanger assemblies.

Referring now to FIG. 11, floor cabinets 11 are supported against a wall 100 by means of cabinet hangers 101, which are mounted on the cabinet unit, and wall hangers 110, which are mounted on wall 100. Cabinet hangers 101 include a top support member 102, which is mounted substantially horizontal across rear wall 50 near upper edge 53, and bottom support member 107, which is mounted substantially horizontal across rear wall 50 near lower edge 54 in opposition to top support member 102, as will be described herein.

Top support member 102 preferably has a width 106 (shown in FIG. 5) equal to that of rear wall 50 and has a bottom edge 104 that is fitted with a slot 105 to facilitate hanging of floor cabinet 11 on wall hanger 110. Likewise, bottom support member 107 preferably has a width 106 (shown in FIG. 5) equal to that of rear wall 50, but has a top edge 108 that is fitted with a slot 109 so that when support members 102 and 107 are attached to rear wall 50, they are a mirror image of each other.

The mirror-image relationship of support members 102 and 107 enables the consumer to install modular cabinets 11 and 12 in two positions, one of which is rotated 180 degrees from the other about an axis 117 which runs horizontally and parallel to side walls 31 and 32. In other words, the consumer can "flip over" the cabinet unit if desired. This feature is advantageous because it provides the consumer with various options when configuring modular cabinets 11 and 12 along any particular wall space.

Still referring to FIG. 11, for each set of prefabricated cabinet assemblies 10, wall hangers 110 are attached to wall 100 upon which cabinet assemblies 10 will be installed. The location and size of wall hangers 110 will depend on the desired height and width of cabinet assembly 10.

Wall hanger 110 is mounted substantially horizontal along wall 100, and preferably has a top edge 113 that is fitted with a slot 114 which interlocks with slot 105 of top support member 102 or slot 109 of bottom support member 107. The interlocking relationship of slots 105, 102, and 109 allows the consumer to slidably adjust modular cabinets 11 and 12 along wall 100 to the desired lateral location before placing spacer panels 70 between adjacent cabinet units. Slotted surfaces 105,102, and 109 also enable a person with little or no carpentry skills to secure modular cabinets 11 and 12 to wall 100.

The present invention may also include a support segment 112 which can be mounted parallel to and below wall hanger 110. The purpose of support segment 112 is to provide a spacer between rear wall 50 and wall 100, and to provide another point of attachment of the cabinet unit to wall 100.

If the consumer is hanging floor cabinets 11, then support segment 112 is attached along wall 100 upon which cabinet assembly 10 will be installed at a height below wall hanger 110, but above lower edge 54 of rear wall 50. However, if the consumer is hanging wall cabinets 12, then support member 112 is attached along wall 100 at a height below top wall hanger 110, but above bottom support member 107 of wall cabinet 12.

Figure 12:
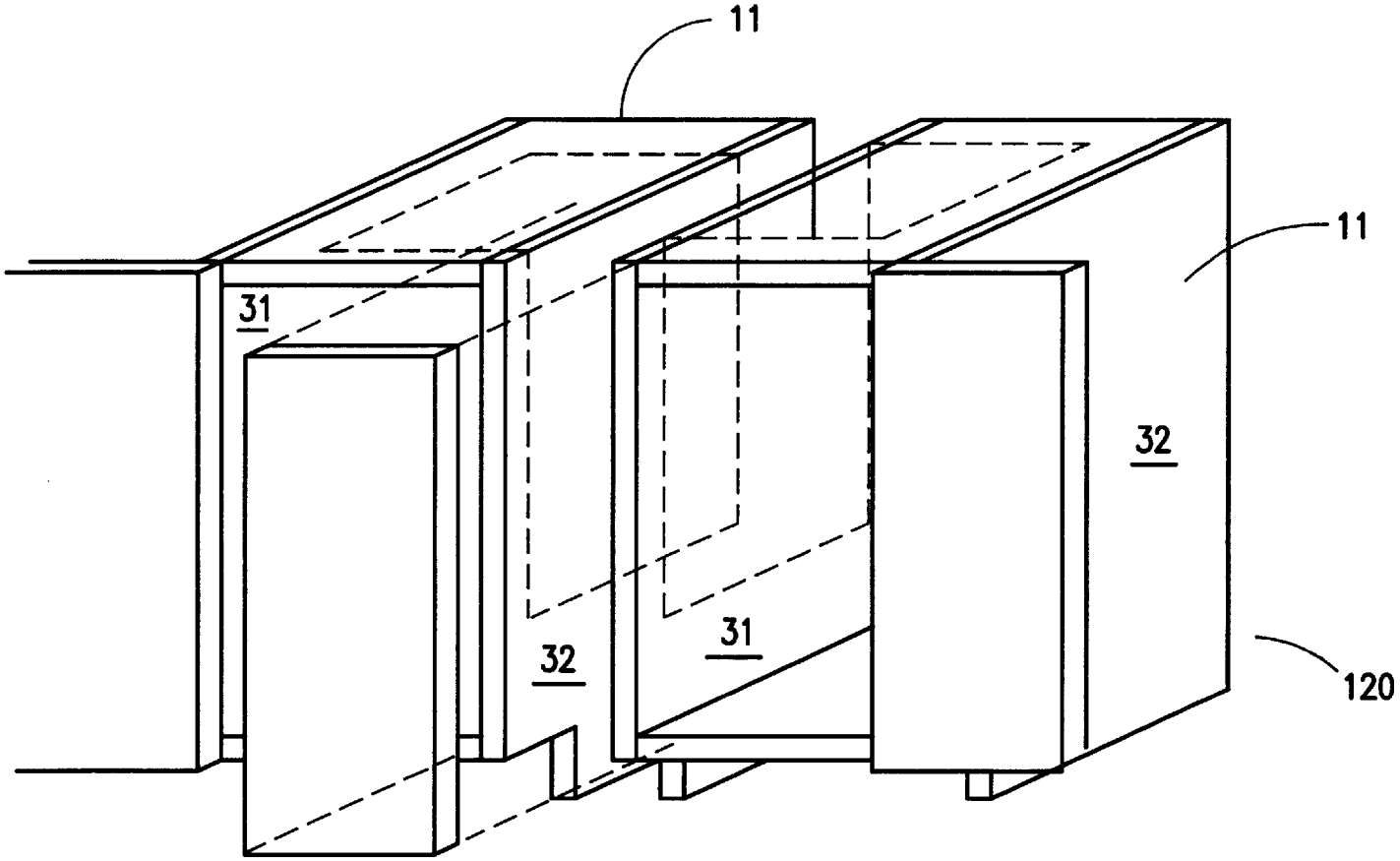
FIG. 12 is a isometric view of a cabinet assembly equipped to accommodate a sink or range top.

In an alternative embodiment of the present invention, floor cabinet 11 can be prefabricated as a sink cabinet assembly 120, as shown in FIG. 12. Sink cabinet assembly 120 is typically constructed by joining two floor cabinets 11 side-by-side and cutting a portion of the inner-most side walls 31 or 32 to accommodate a standard size sink.

Although the description above contains many specificities, these should not be construed as limiting the scope of the invention but as merely providing illustrations of some of the presently preferred embodiments. Thus the scope of the invention should be determined by the appended claims and their legal equivalents, rather than by the examples given.

I claim:

1. A cabinet assembly for mounting on a wall structure, comprising:

(a) at least one cabinet unit comprising two opposing sides and a rear wall;

(b) a cabinet hanger mounted on said cabinet unit, said cabinet hanger comprising:

(1) a substantially horizontal first bar attached to said rear wall of said cabinet unit, said first bar comprising a bottom-facing edge having a slot therein; and (2) a second bar mounted on said rear wall of said at least one cabinet unit in spaced-apart, substantially parallel relationship with said first bar, wherein said second bar has a top-facing edge fitted with a slot for installing said cabinet unit upside down if desired;

(c) a wall hanger adapted to be attached to said wall structure, said wall hanger comprising a substantially horizontal bar having a top-facing edge with a slot interlocked with said cabinet hanger;

(d) at least one spacer panel connected to at least one of said sides of said at least one cabinet unit, said at least one spacer panel having a front face, a back face, two side edges, and a width;

(e) a plurality of substantially vertical slots spaced along said back face of said at least one spacer panel; and (f) a plurality of visible cut lines on said back face of said at least one spacer panel, each of said cut lines running substantially parallel to said vertical slots, whereby when said at least one spacer panel is cut along said cut line, said vertical slot forms a shoulder adapted to abut a side of said at least one cabinet unit and at least partially cover an outward edge of said side of said at least one cabinet unit.

2. The cabinet assembly of claim 1, wherein said vertical cut lines are positioned substantially along a centerline of each said vertical slots.

3. The cabinet assembly of claim 2, wherein said at least one cabinet unit comprises at least two cabinet units.

4. The cabinet assembly of claim 1, wherein said vertical cut lines are positioned substantially intermediate each of said vertical slots.

5. The cabinet assembly of claim 4, wherein said at least one cabinet unit comprises at least two cabinet units.

6. An improved wall cabinet installation, comprising:

(a) at least two cabinet units, each of said at least two cabinet units comprising two spaced-apart opposed side walls and a rear wall;

(b) a cabinet hanger mounted on said at least two cabinet units, said cabinet hanger comprising:

(1) a substantially horizontal first bar attached to said rear wall of said at least two cabinet units, said first bar comprising a bottom-facing edge having a slot therein; and (2) a second bar mounted on said rear wall of said at least two cabinet units in spaced-apart, substantially parallel relationship with said first bar, wherein said second bar has a top-facing edge fitted with a slot for installing said at least two cabinet units upside down if desired;

(c) a wall hanger fastened to a wall structure, said wall hanger comprising a a substantially horizontal bar having a top-facing edge with a slot adapted to interlock with said slot of said first bar or said second bar of said cabinet hanger, wherein said at least two cabinet units are suspended in adjoining, spaced-apart relationship on said wall structure by interlocking said cabinet hanger and said wall hanger;

(d) at least one spacer panel disposed between adjacent cabinet units, spanning a space therebetween, each of said at least one spacer panels having a front face, a back face, two side edges, and a width;

(e) a plurality of substantially vertical slots spaced along said back face of said at least one spacer panel; and (f) a plurality of visible cut lines on said back face of said at least one spacer panel, each of said cut lines running substantially parallel to said vertical slots, whereby when said at least one spacer panel is cut along said cut line, said vertical slot forms a shoulder adapted to abut a side of said at least one cabinet unit and at least partially cover an outward edge of said side of said at least one cabinet unit.

7. A method of installing a cabinet assembly to occupy a desired span of wall space, comprising the steps of:

(a) providing at least two cabinet units, each of said at least two cabinet units comprising two spaced-apart opposed side walls, a rear wall, a first bar mounted on an exterior surface of said rear wall of each of said at least two cabinet units, said first bar mounted substantially horizontally and spanning a width of each of said at least two cabinet units, said first bar comprising a bottom-facing edge with a slot therein, and a second bar mounted on said rear wall of said at least two cabinet units in spaced-apart, substantially parallel relationship with said first bar, wherein said second bar has a top-facing edge fitted with a slot for installing said cabinet unit upside down if desired;

(b) fastening to a wall structure a substantially horizontal wall hanger bar having a top-facing edge with a slot adapted to interlock with said slot of said first bar or said second bar;

(c) mounting said at least two cabinet units on said wall structure by interlocking said first bar or said second bar and said wall hanger bar;

(d) laterally sliding each of said at least two cabinet units into position on said wall structure, leaving a desired space between each of said at least two cabinet units;

(e) determining the width of said desired spaces between each of said at least two cabinet units;

(f) providing a sufficient number of spacer panels to correspond to said desired spaces between said at least two cabinet units, each of said spacer panels comprising a plurality of substantially vertical slots spaced along said back face and a plurality of visible cut lines on said back face, each of said cut lines running substantially parallel to said vertical slots, (g) cutting each of said spacer panels along said cut lines to an appropriate width to span said desired spaces between said cabinet unit, and to conform with said sides of said at least two cabinet units to enhance the professional appearance of said at least two cabinet units; and (h) mounting said spacer panels to adjacent cabinet units, thereby spanning said spaces between adjacent cabinet units, and conforming with said sides of said at least two cabinet units thereby enhancing the appearance of said at least two cabinet units.

* * * * *